US008201645B2

(12) United States Patent
Hall et al.

(10) Patent No.: US 8,201,645 B2
(45) Date of Patent: Jun. 19, 2012

(54) DOWNHOLE TOOL STRING COMPONENT THAT IS PROTECTED FROM DRILLING STRESSES

(75) Inventors: David R. Hall, Provo, UT (US); Nathan Nelson, Provo, UT (US); Scott Woolston, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 150 days.

(21) Appl. No.: 12/616,200

(22) Filed: Nov. 11, 2009

(65) Prior Publication Data

US 2010/0051256 A1 Mar. 4, 2010

Related U.S. Application Data

(63) Continuation-in-part of application No. 11/841,101, filed on Aug. 20, 2007, now Pat. No. 7,669,671, which is a continuation-in-part of application No. 11/688,952, filed on Mar. 21, 2007, now Pat. No. 7,497,254.

(51) Int. Cl.
*E21B 17/10* (2006.01)

(52) U.S. Cl. ..... 175/320; 175/325.1

(58) Field of Classification Search ..... 175/320, 175/325.1, 325.2; 166/242.6
See application file for complete search history.

(56) References Cited

U.S. PATENT DOCUMENTS

| | | | | |
|---|---|---|---|---|
| 1,817,772 | A | | 8/1931 | Sipe |
| 1,846,539 | A | | 2/1932 | Baurmann |
| 1,977,175 | A | | 10/1934 | Davis |
| 2,066,473 | A | | 1/1937 | Jorgensen |
| 2,325,811 | A | | 8/1943 | Terrell |
| 2,354,687 | A | | 8/1944 | Silverman |
| 2,664,272 | A | | 12/1953 | Boice |
| 2,676,820 | A | | 4/1954 | Boice |
| 2,999,552 | A | | 9/1961 | Fox |
| 3,079,549 | A | | 2/1963 | Martin |
| 3,085,939 | A | | 4/1963 | Fitch |
| 3,126,173 | A | | 3/1964 | Fox |
| 3,146,611 | A | | 9/1964 | Fox |
| 3,175,374 | A | | 3/1965 | Toelke |
| 3,186,222 | A | | 6/1965 | Martin |
| 3,194,331 | A | | 7/1965 | Arnold |
| 3,338,069 | A | | 8/1967 | Ortoff |
| 3,360,960 | A | | 1/1968 | Msassey |
| 3,554,307 | A | | 1/1971 | Yount |
| 3,606,402 | A | | 9/1971 | Medney |
| 3,642,079 | A | * | 2/1972 | Van Note ..... 175/325.2 |
| 3,773,359 | A | | 11/1973 | Chance |
| 3,793,632 | A | | 2/1974 | Still |
| 3,876,972 | A | | 4/1975 | Garrett |
| 3,903,974 | A | | 9/1975 | Cullen |
| 3,968,473 | A | | 7/1976 | Patton |
| 4,204,707 | A | | 5/1980 | Lincicome |

(Continued)

*Primary Examiner* — William P Neuder
(74) *Attorney, Agent, or Firm* — Brinks Hofer Gilson & Lione

(57) ABSTRACT

In one aspect of the present invention, a downhole tool string component has a first and second threaded end on a mandrel, the first threaded end attached to a first sleeve and the second threaded end attached to a second sleeve. An intermediate sleeve assembly is disposed circumferentially around the mandrel and intermediate the first and second threaded ends, and the intermediate sleeve assembly is primarily isolated from stress of the first or second sleeve.

16 Claims, 5 Drawing Sheets

U.S. PATENT DOCUMENTS

| | | | | |
|---|---|---|---|---|
| 4,215,426 | A | 7/1980 | Klatt | |
| 4,328,704 | A | 5/1982 | Arpasi | |
| 4,365,678 | A | 12/1982 | Fitch | |
| 4,460,202 | A | 7/1984 | Chance | |
| 4,479,564 | A | 10/1984 | Tanguy | |
| 4,683,944 | A | 8/1987 | Curlett | |
| 4,722,402 | A | 2/1988 | Weldon | |
| 4,785,247 | A | 11/1988 | Meador et al. | |
| 4,811,597 | A | 3/1989 | Hebel | |
| 4,811,800 | A | 3/1989 | Hill | |
| 4,892,337 | A | 1/1990 | Gunderson | |
| 5,039,137 | A | 8/1991 | Cankovic | |
| 5,040,620 | A | 8/1991 | Nunley | |
| 5,040,622 | A | 8/1991 | Winship | |
| 5,248,857 | A | 9/1993 | Ollivier | |
| 5,334,801 | A | 8/1994 | Mohn | |
| 5,343,949 | A | 9/1994 | Ross et al. | |
| 5,691,712 | A | 11/1997 | Meek | |
| 5,950,744 | A | 9/1999 | Hughes | |
| 5,988,276 | A | 11/1999 | Oneal | |
| 6,012,744 | A | 1/2000 | Wilson | |
| 6,026,897 | A | 2/2000 | Pringle | |
| 6,619,392 | B2 | 9/2003 | Marangoni et al. | |
| 6,655,452 | B2 | 12/2003 | Zillinger | |
| 6,666,274 | B2 | 12/2003 | Hughes | |
| 6,851,489 | B2 | 2/2005 | Hinds | |
| 6,896,049 | B2 | 5/2005 | Moyes | |
| 6,983,796 | B2 | 1/2006 | Bayne et al. | |
| 7,093,680 | B2 * | 8/2006 | Holbert et al. | 175/320 |
| 7,267,185 | B2 | 9/2007 | Underwood et al. | |
| 7,493,960 | B2 | 2/2009 | Leising et al. | |
| 2002/0139582 | A1 | 10/2002 | Caraway et al. | |
| 2003/0070842 | A1 | 4/2003 | Bailey | |
| 2004/0067002 | A1 | 4/2004 | Berg et al. | |
| 2004/0094309 | A1 * | 5/2004 | Maguire | 166/381 |
| 2004/0184671 | A1 | 9/2004 | Luft | |
| 2004/0256153 | A1 * | 12/2004 | Helms et al. | 175/45 |
| 2005/0155770 | A1 | 7/2005 | Parrott | |
| 2007/0272444 | A1 | 11/2007 | Carlson et al. | |

* cited by examiner

DOWNHOLE TOOL STRING COMPONENT THAT IS PROTECTED FROM DRILLING STRESSES

CROSS REFERENCE TO RELATED APPLICATIONS

This application is a continuation-in-part of U.S. patent application Ser. No. 11/841,101 entitled "Segmented Sleeve on a Downhole Tool String Component" which was filed on Aug. 20, 2007 and is now U.S. Pat. No. 7,669,671 issued on Mar. 2, 2010. U.S. patent application Ser. No. 11/841,101 is a continuation-in-part of U.S. patent application Ser. No. 11/688,952 entitled "Pocket for a Downhole Tool String Component" which was filed on Mar. 21, 2007 and is now U.S. Pat. No. 7,497,254 issued on Mar. 3, 2009. The above-mentioned references are herein incorporated by reference for all that they disclose.

BACKGROUND

This invention relates to downhole drilling, particularly to downhole drilling for oil, gas, and geothermal, and to horizontal drilling. More specifically, the invention relates to downhole drilling stresses including compressive stress and rotary torque. While drilling, the stresses seen by the drill string may be routed through the drill string to specific components leaving others substantially stress free.

U.S. Pat. No. 7,193,526 to Hall et al., which is herein incorporated by reference for all that it contains, discloses a double shouldered downhole tool connection comprising box and pin connections having mating threads intermediate, or between, mating primary and secondary shoulders. The tool connection further comprises a secondary shoulder component retained in the box connection intermediate, or between, a floating component and the primary shoulders. The secondary shoulder component and the pin connection cooperate to transfer a portion of makeup load to the box connection. The downhole tool may be selected from the group consisting of drill pipe, drill collars, production pipe, and reamers. The floating component may be selected from the group consisting of electronics modules, generators, gyroscopes, power sources, and stators. The secondary shoulder component may include an interface to the box connection selected from the group consisting of radial grooves, axial grooves, tapered grooves, radial protrusions, axial protrusions, tapered protrusions, shoulders, and threads.

U.S. Pat. No. 7,377,315 to Hall et al., which is herein incorporated by reference for all that it contains, discloses a downhole tool string component with a tubular body and a first and second end. At least one end is adapted for axial connection to an adjacent downhole tool string component. A covering, secured at its ends to an outside diameter of the tubular body, forms an enclosure with the tubular body. The covering has a geometry such that when a stress is induced in the sleeve by bending the downhole tool string component, that stress is less than or equal to stress induced in the tubular body. The covering may be a sleeve. Further, the geometry may comprise at least one stress relief groove formed in both an inner surface and an outer surface of the covering.

BRIEF SUMMARY

In one embodiment of the present invention, a downhole tool string component has a first and second threaded end on a mandrel, the first threaded end attached to a first sleeve and the second threaded end attached to a second sleeve. An intermediate sleeve assembly is disposed circumferentially around the mandrel and intermediate or between the first and second threaded ends and the intermediate sleeve assembly is primarily isolated from stress of the first or second sleeve.

The intermediate sleeve assembly may include a stabilizer blade. The intermediate sleeve assembly may form at least a portion of a downhole tool bay. The downhole tool bay may be removable. The mandrel may form at least a portion of a downhole tool bay. The first and/or second sleeve may be more rigidly attached to the mandrel than the intermediate sleeve assembly. The first and/or second sleeve may be disposed circumferentially around a pressure vessel. An electronics bay may be disposed intermediate or between the pressure vessel and the first or second sleeve. The electronics bay may include at least one electronics bay seal, the electronics bay seal being disposed proximate an end of the electronics bay and restricting a change in pressure within the electronics bay. The electronics bay may be disposed annularly around the pressure vessel.

The tool string may comprise a first threaded anchor disposed intermediate, or between, the first sleeve and the intermediate sleeve assembly. The first threaded anchor and the first sleeve may be separated by at least 0.01 mm. A second threaded anchor may be disposed intermediate, or between, the second sleeve and the intermediate sleeve assembly. The second threaded anchor and the second sleeve may be separated by at least 0.01 mm. The pressure vessel may have an electrical connection with the mandrel. The pressure vessel may be slidably connected to the first sleeve or the second sleeve. The intermediate sleeve assembly may include at least two components that are restricted from rotating relative to each other by at least one anti-rotation pin. The anti-rotation pin may be at least partially disposed within a recess formed within the mandrel.

In another aspect of the present invention, a downhole tool string component has a first and second threaded end on a mandrel, the first threaded end attached to a first sleeve and the second end attached to a second sleeve. An intermediate sleeve assembly is disposed circumferentially around the mandrel and intermediate, or between, the first and second threaded ends. The intermediate sleeve has a tool bay and the tool bay is primarily isolated from stress of the first or second sleeve. The intermediate sleeve assembly may have a stabilizer blade.

DETAILED DESCRIPTION

Figure 1:
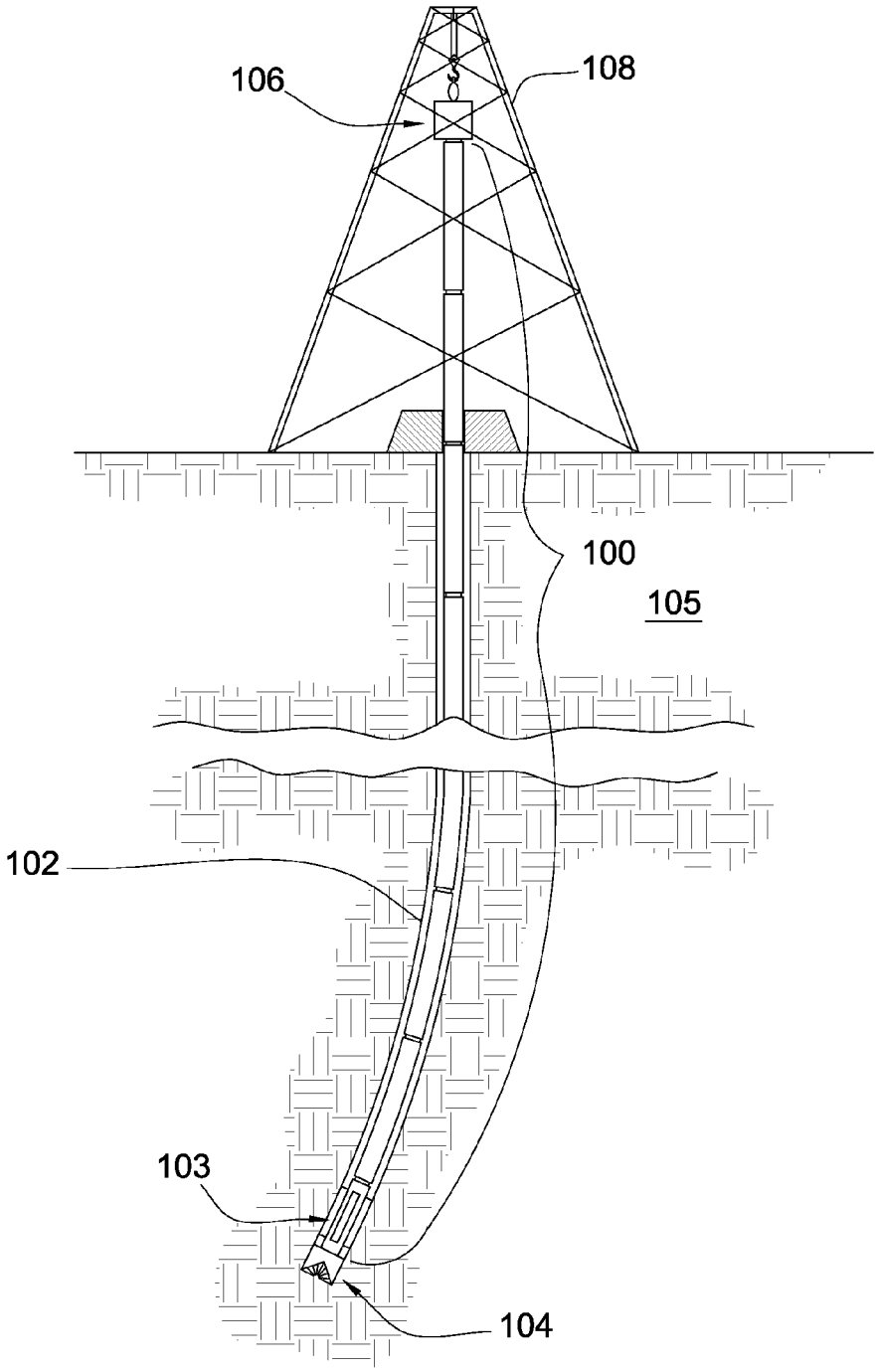
FIG. 1 is an orthogonal cross-sectional diagram of an embodiment of a drill string suspended in a bore hole.

FIG. 1 is an orthogonal diagram of an embodiment of a downhole tool string 100 suspended in a bore hole 102 by a derrick 108. A drilling assembly 103 is located at a bottom of the bore hole 102 and comprises a drill bit 104. As the drill bit 104 rotates downhole, the downhole tool string 100 advances farther into the earth. The downhole tool string 100 may penetrate soft or hard subterranean formations 105. The drilling assembly 103 and/or downhole components may comprise data acquisition devices which may gather data. The data may be sent to the surface via a transmission system to a data swivel 106. The data swivel 106 may send the data to surface equipment. The surface equipment may send data and/or power to downhole tools, the drill bit 104 and/or the drilling assembly 103. The downhole tool string 100 may include a downhole tool. The downhole tool may be selected from the group consisting of drill pipe, drill collars, production pipea , and reamers. The downhole tool string 100 may include be subjected to downhole drilling stresses as at least a portion of the weight of the downhole tool string 100 is placed on the drill bit 104. The drilling stresses may be compressive stresses, tensile stresses, and/or torque stresses propagating through portions of the downhole tool string 100.

Figure 2:
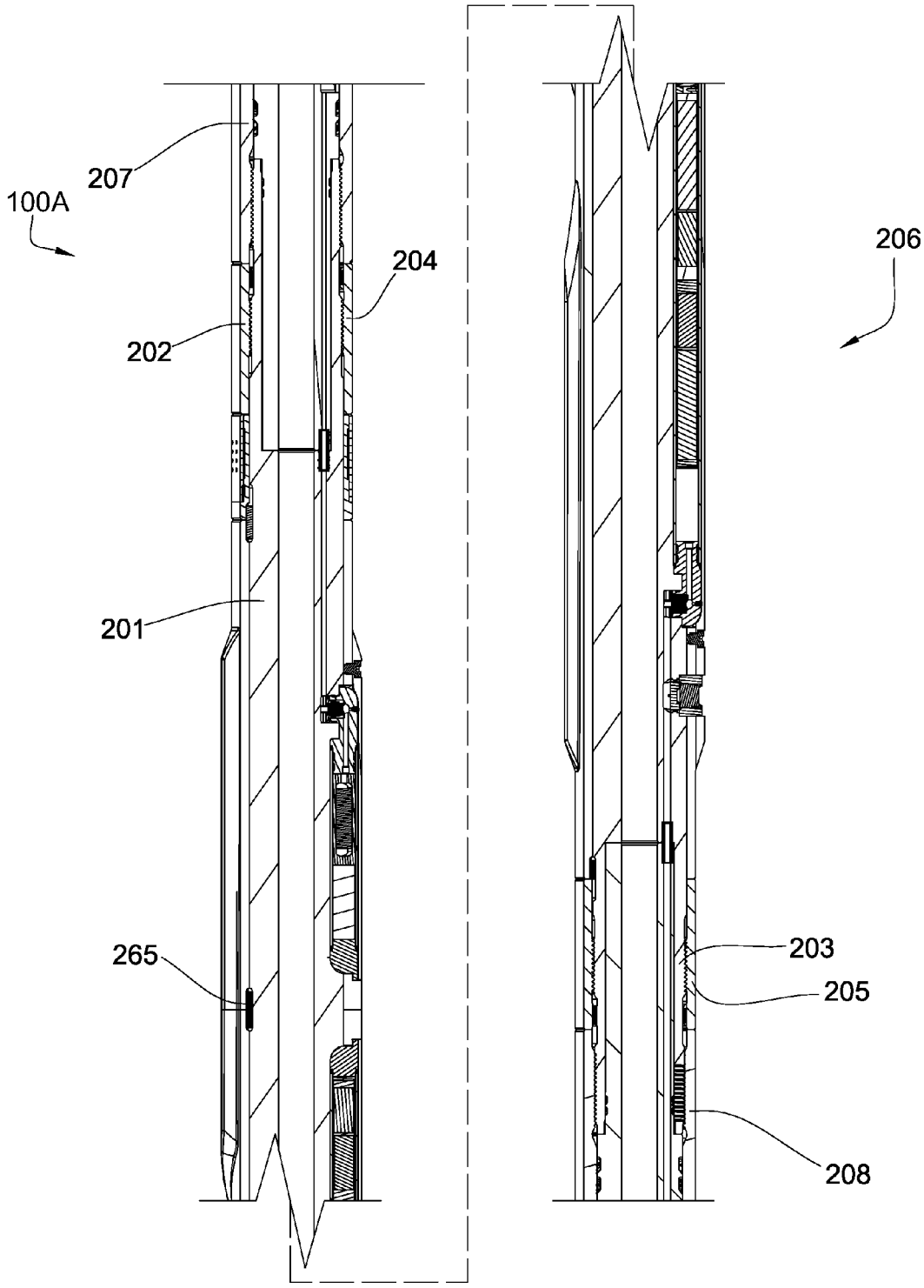
FIG. 2 is a cross-sectional diagram of an embodiment of a portion of a drill string.

FIG. 2 is a cross-sectional diagram of a portion of an embodiment of a downhole drill string 100A. The downhole drill string 100A may include a mandrel 201 with a first end 202 and a second end 203. The first end 202 and the second end 203 may threadably connect to a first threaded anchor 204 and a second threaded anchor 205, respectively. An intermediate sleeve assembly 206 may be held in place intermediate, or between, the first threaded anchor 204 and the second threaded anchor 205 and around the mandrel 201. The intermediate sleeve assembly 206 may be a stabilizer. The stabilizer may be segmented both along an axis of the downhole drill string 100A and at some point along the length of a stabilizer blade. The first threaded end 202 and the second threaded end 203 may also threadably connect to a first sleeve 207 and a second sleeve 208. The intermediate sleeve assembly 206 may be a downhole tool bay adapted to hold downhole drilling tools such as sensors including, but not limited to, pressure sensors, accelerometers, hydrophones, piezoelectric devices, inclinometers, pressure transducers, magnetometers, gyroscopes, temperature sensors, gamma ray sensors, neutron sensors, seismic sensors, sonic sensors, mud logging devices, resistivity sensors, induction sensors, nuclear sensors, transmitters, receivers, imaging devices, GPS devices, Hall-effect sensors, permeability sensors, porosity sensors, vibration sensors, electrical potential sensors, geophones, proton neutron generators, batteries or the like. The downhole drilling tools within the downhole tool bay may be powered by a downhole source such as a generator, battery turbine, or combinations thereof.

The intermediate sleeve assembly 206 may be partitioned into segments. To restrict rotation of the segments of the intermediate sleeve assembly 206 relative to each other, at least one anti-rotation pin 265 may be disposed within each adjacent segment. Additionally, the anti-rotation pin may be seated within a groove formed within the mandrel 201. Thus, while the drill string 100 rotates downhole, the intermediate sleeve assembly segments may be restricted from rotation relative to each other by the anti-rotation pin 265.

The downhole drill string 100A may experience stick slip while engaging against the side of the borehole. In embodiments where intermediate sleeve assembly 206 has a stabilizer blade, the drill string 100A may not experience as much additional torque if the intermediate sleeve assembly 206 is restricted from transmitting torque to the mandrel 201. The intermediate sleeve assembly 206 may be adapted to maximize the stabilizer blade contact with the borehole to center the downhole drill string 100A while drilling. In some embodiments, the stabilizer blade may house electronics, thereby improving their coupling to formation.

To ensure proper transfer of stress from the first sleeve 207 and/or the second sleeve 208, the first sleeve 207 and/or the second sleeve 208 may be more rigidly attached to the mandrel 201 than the intermediate sleeve assembly 206. In other embodiments, the intermediate sleeve assembly 206 may freely rotate around the mandrel 201 without the restriction of an anti-rotation pin against the mandrel 201.

Figure 3:
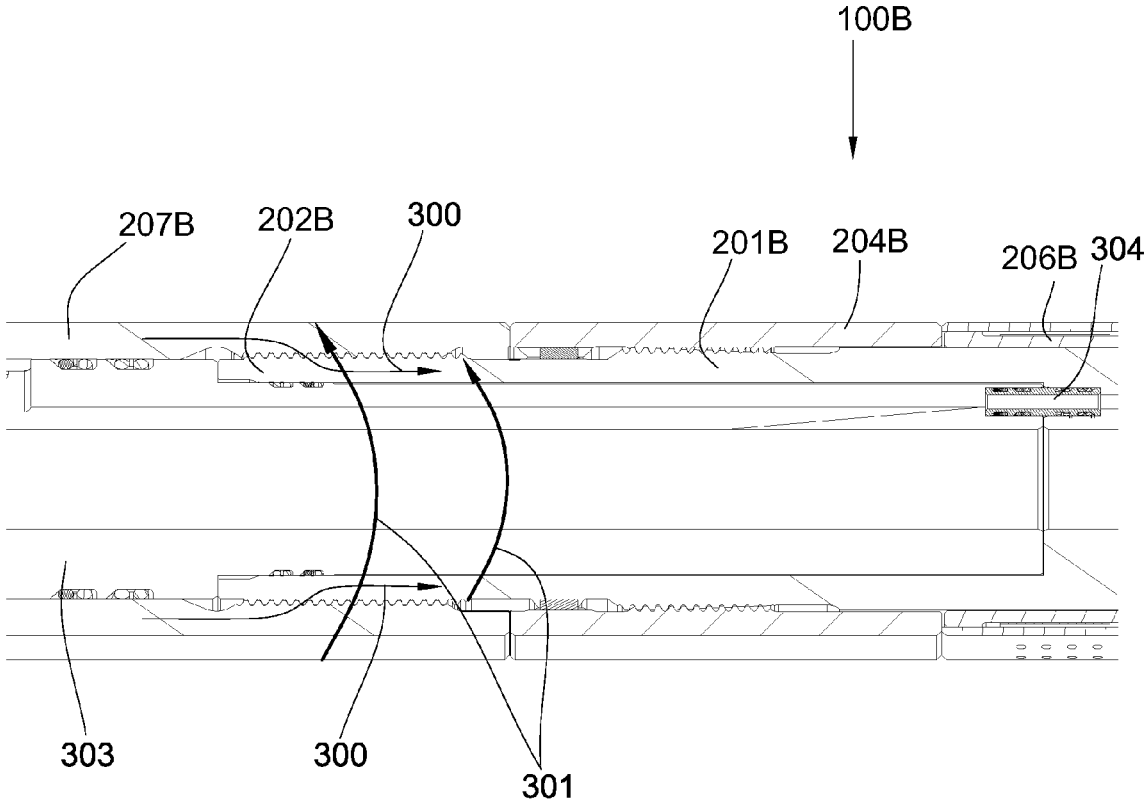
FIG. 3 is a cross-sectional diagram of an embodiment of a portion of a drill string.

FIG. 3 is a cross-sectional diagram of a portion of an embodiment of a drill string 100B. In this diagram, a mandrel 201B has a first threaded end 202B threadably connected to a first sleeve 207B. While in operation, the drill string 100B rotates in a borehole, advancing farther into a formation. As the drill string 100B advances, inherent downhole stresses may be found along the drill string 100B from contact with the side of the borehole and/or stress induced by contact of a drill bit (not shown) with the borehole. The weight of the drill string 100B may rest on the drill bit disposed at the end of the drill string 100B resulting in compressive stresses generally along the length of the drill string 100B. Those compressive stresses may be transferred from component to component.

In the embodiment of FIG. 3, a first sleeve 207B is more rigidly attached to the mandrel 201B than the first sleeve 207B is connected to an intermediate sleeve assembly 206B. An anchor 204B may pick up a majority of the first sleeve's 207B make-up torque. The make-up torque between the anchor 204B and the intermediate sleeve assembly 206B may be minimal. In some embodiments, the make-up torque between the anchor 204B and the intermediate sleeve assembly 206B may be only sufficient enough to hold the intermediate sleeve assembly 206B in place through the drilling process.

The stresses may be rerouted from the first sleeve 207B to the mandrel 201B, bypassing the intermediate sleeve assembly 206B. Farther down the drill string 100B, the mandrel 201B may route the stresses back into a second sleeve while preventing the stresses from being transferred into the intermediate sleeve assembly 206B. Arrows 300 display the path of the compressive stresses. Likewise, arrows 301 disclose rotary torque transferred from the first sleeve 207B to the mandrel 201B. Rerouting the stresses may insulate the intermediate sleeve assembly 206B from a majority of the downhole stresses. By placing tools within the intermediate sleeve assembly 206B, the tools may be isolated from downhole drilling stresses.

Additionally, electrical connections from downhole drilling tools located in the intermediate sleeve assembly 206B may be routed from the intermediate sleeve assembly 206B to a pressure vessel 303 through a joint-to-joint electrical connection 304. The pressure vessel 303 may be proximate the intermediate sleeve assembly 206B.

In some embodiments, there are no anchors 204B. The first sleeve 207B and the second sleeve hold the intermediate sleeve assembly 206B in place. The make-up torque is at least mostly taken up in the threads between the mandrel 201B and the first sleeve 207B and the second sleeve, not the sleeve shoulders.

Figure 4:
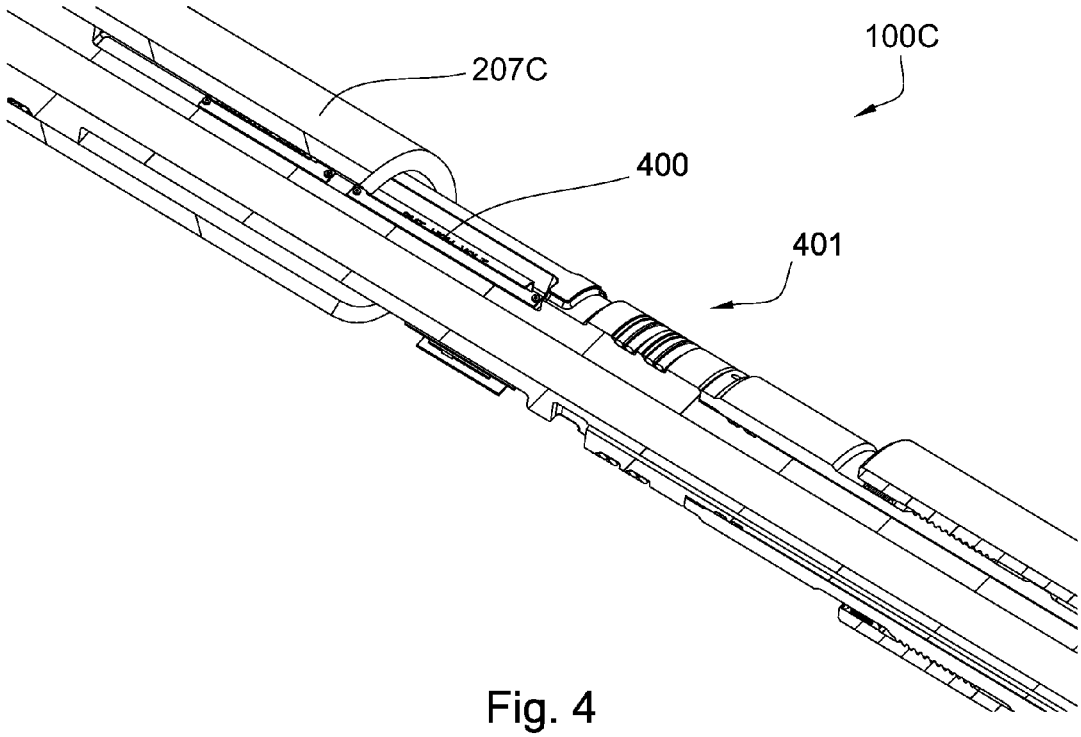
FIG. 4 is a perspective cross-sectional diagram of an embodiment of a portion of a drill string.

FIG. 4 is a perspective cross-section of a portion of an embodiment of a drill string 100C. A first sleeve 207C is seen partially removed from the drill string 100C. By removing a portion of the first sleeve 207C, an electronics bay 400 is revealed. The electronics bay 400 may house electronic components used in downhole drilling which may include, but is not limited to communication electronics, control electronics, acquisition electronics, pressure transducers, accelerometers, memory and/or combinations thereof. When covered, the electronics bay 400 may be sealed from drilling mud or other debris found in a downhole environment. The electronics bay 400 may be further isolated by a seal stack 401 disposed on the drill string 100C.

Figure 5:
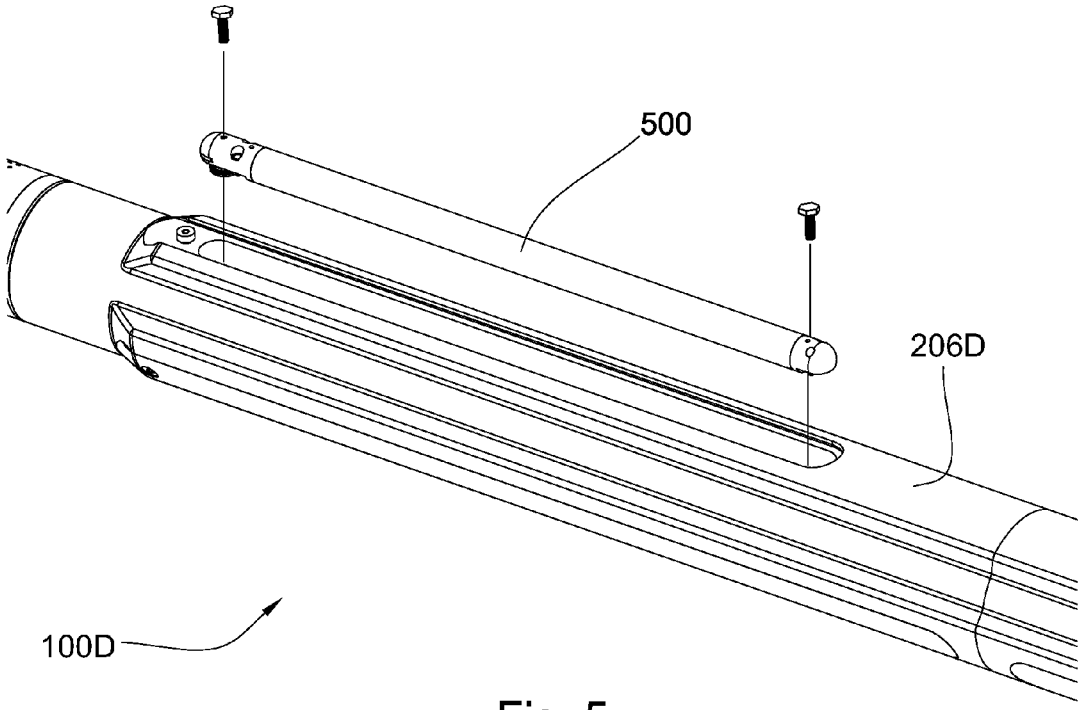
FIG. 5 is a perspective diagram of an embodiment of a portion of a drill string.

FIG. 5 is a perspective diagram of an embodiment of a portion of a drill string 100D. A downhole tool 500 may be inserted into an intermediate sleeve assembly 206D isolated from downhole drilling stresses. The downhole tool 500 may be secured into the intermediate sleeve assembly 206D by screws as shown. The downhole tool 500 may be removable. Other downhole tools 500 may be circumferentially spaced along the intermediate sleeve assembly 206D.

Figure 6:
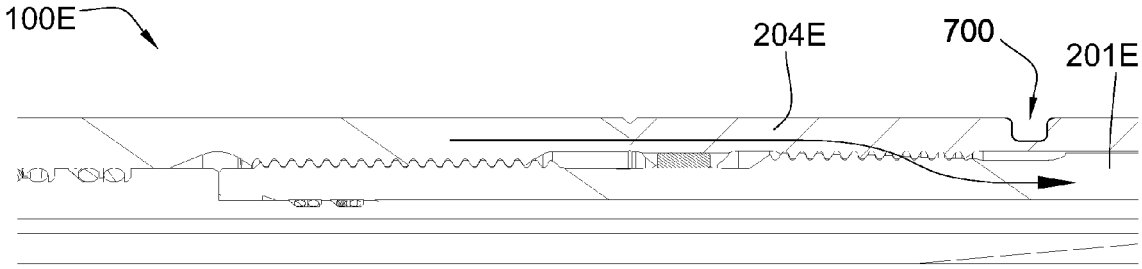
FIG. 6 is a cross-sectional diagram of an embodiment of another portion of a drill string.

FIG. 6 is a cross-sectional diagram of a portion of an embodiment of a drill string 100E. In this embodiment, a recess 700 is formed in a first threaded anchor 204E and is adapted to direct the stresses from the first threaded anchor 204E to a mandrel 201E. The recess 700 may also be formed in a second threaded anchor 205E and adapted to direct the stresses from the mandrel 201E to the second threaded anchor 205E or from the second threaded anchor 205E to the mandrel 201E depending on the orientation of the drill string 100E.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component, comprising;

a mandrel having a first threaded end and a second threaded end spaced apart from the first threaded end;

a first sleeve threadably connected to the first threaded end;

a second sleeve threadably connected to the second threaded end;

an intermediate sleeve assembly isolated from stress of the first sleeve and the second sleeve and disposed circumferentially around the mandrel between the first threaded end and the second threaded end; and a first anchor disposed between the intermediate sleeve assembly and the first sleeve.

2. The tool string component of claim 1, wherein the intermediate sleeve assembly includes a stabilizer blade.

3. The tool string component of claim 1, wherein the intermediate sleeve assembly includes at least a portion of a downhole tool bay.

4. The tool string component of claim 3, wherein the downhole tool bay is removable.

5. The tool string component of claim 1, wherein the first sleeve is attached to the mandrel more rigidly than the intermediate sleeve assembly is attached to the mandrel.

6. The tool string of claim 1, wherein the first sleeve is disposed circumferentially around a pressure vessel.

7. The tool string of claim 6, wherein an electronics bay is disposed between the pressure vessel and the first sleeve.

8. The tool string of claim 7, wherein the electronics bay includes at least one electronics bay seal, the electronics bay seal is disposed proximate an end of the electronics bay.

9. The tools string of claim 7, wherein the electronics bay is disposed annularly around the pressure vessel.

10. The tool string of claim 6, wherein the pressure vessel includes an electrical connection with the mandrel.

11. The tool string of claim 1, wherein the tool string includes a second threaded anchor disposed between the second sleeve and the intermediate sleeve assembly.

12. The tool string of claim 6, wherein the pressure vessel is slidably connected to the first sleeve.

13. The tool string of claim 1 further comprising an anti-rotation pin, wherein the anti-rotation pin restricts at least two components from rotating relative to each.

14. The tool string of claim 13, wherein the mandrel has a recess formed therein, and the anti-rotation pin is at least partially disposed within the recess.

15. A downhole tool string component, comprising;

a mandrel having a first threaded end and a second threaded end;

a first sleeve threadably attached to the first end;

a second sleeve threadably attached to the second end; and an intermediate sleeve assembly having a tool bay isolated from a stress of the first sleeve and the second sleeve, the intermediate sleeve assembly being disposed circumferentially around the mandrel and between the first threaded end and the second threaded end.

16. The tool string of claim 15, wherein the intermediate sleeve assembly includes a stabilizer blade.

* * * * *